US010012464B2

(12) United States Patent
Bray

(10) Patent No.: US 10,012,464 B2
(45) Date of Patent: Jul. 3, 2018

(54) MUZZLE SIGNATURE MANAGEMENT DEVICE

(71) Applicant: NG2 Defense, LLC, American Fork, UT (US)

(72) Inventor: Ernest R. Bray, American Fork, UT (US)

(73) Assignee: NG2 DEFENSE, LLC, American Fork, UT (US)

( * ) Notice: Subject to any disclaimer, the term of this patent is extended or adjusted under 35 U.S.C. 154(b) by 0 days.

(21) Appl. No.: 15/353,598

(22) Filed: Nov. 16, 2016

(65) Prior Publication Data

US 2017/0191782 A1 Jul. 6, 2017

Related U.S. Application Data

(60) Provisional application No. 62/219,483, filed on Sep. 16, 2015.

(51) Int. Cl.
*F41A 21/34* (2006.01)
*F41A 21/36* (2006.01)

(52) U.S. Cl.
CPC ..... *F41A 21/34* (2013.01); *F41A 21/36* (2013.01)

(58) Field of Classification Search
CPC ..... F41A 21/34; F41A 21/36; F41A 21/32; F41A 21/325; F41A 21/38
USPC ..... 89/14.2, 14.3, 14.4
See application file for complete search history.

(56) References Cited

U.S. PATENT DOCUMENTS 812,140 A * 2/1906 Kent ..... F41A 21/28 89/14.3
913,484 A * 2/1909 Fairall ..... F16L 37/248 285/361
2,351,037 A * 6/1944 Green ..... F41A 21/34 89/14.5
2,558,200 A * 6/1951 Schmeling ..... F41A 21/40 42/79
2,667,815 A * 2/1954 Strong ..... F41A 21/36 89/14.3
3,171,010 A * 2/1965 Potter ..... H05H 1/34 219/75
3,409,232 A * 11/1968 Cholin ..... A62C 13/006 169/11
3,478,417 A * 11/1969 Shaw ..... F41A 21/36 29/558
4,583,445 A * 4/1986 Blair ..... F41A 21/36 89/14.2
5,320,022 A * 6/1994 Kimbro ..... F41A 21/36 89/14.3
6,425,310 B1 * 7/2002 Champion ..... F41A 21/30 89/14.3

(Continued)

*Primary Examiner* — Joshua E Freeman
(74) *Attorney, Agent, or Firm* — Kunzler, PC

(57) ABSTRACT

A muzzle signature management device for a firearm may include a body having a bore through a central axis, a first plurality of linear ports extending generally coaxially with the bore and providing a gas pathway from the bore to the outside surface of the body, a second plurality of linear ports intersecting the first plurality of linear ports and providing a gas pathway from the bore to the outside surface of the body, and a plurality of surface features within the first and second plurality of linear ports configured to affect the discharge gasses exiting from the muzzle of the firearm.

20 Claims, 7 Drawing Sheets

(56) References Cited

U.S. PATENT DOCUMENTS

| | | | | |
|---|---|---|---|---|
| 8,196,701 | B1 * | 6/2012 | Oliver | F41A 21/30 181/223 |
| 8,695,474 | B2 * | 4/2014 | Overbeek Bloem | F41A 21/325 89/14.2 |
| D711,491 | S * | 8/2014 | Nierenberg | D22/108 |
| 9,207,034 | B2 * | 12/2015 | Larson, Jr. | F41A 21/36 |
| 9,441,901 | B1 * | 9/2016 | Harrison | F41A 21/36 |
| 9,593,900 | B2 * | 3/2017 | Vossler | F41A 21/34 |
| 2003/0106416 | A1 * | 6/2003 | Vais | F41A 21/36 89/14.3 |
| 2003/0106417 | A1 * | 6/2003 | Vais | F41A 21/36 89/14.3 |
| 2010/0282056 | A1 * | 11/2010 | Hung | F41A 21/34 89/14.2 |
| 2012/0246987 | A1 * | 10/2012 | Anthony | F41A 21/30 42/1.06 |
| 2014/0216237 | A1 * | 8/2014 | Butler | F41A 21/36 89/14.4 |
| 2015/0308774 | A1 * | 10/2015 | Sherrill | F41A 21/34 89/14.2 |
| 2015/0377577 | A1 * | 12/2015 | Pappas | F41A 21/34 89/14.2 |
| 2017/0299316 | A1 * | 10/2017 | Vossler | F41A 21/34 |

* cited by examiner

MUZZLE SIGNATURE MANAGEMENT DEVICE

CROSS-REFERENCES TO RELATED APPLICATIONS

This application claims the benefit of, U.S. Provisional Patent Application No. 62/219,483 entitled "MUZZLE SIGNATURE MANAGEMENT DEVICE" and filed on Sep. 16, 2015 for Ernest Bray, which is incorporated herein by reference.

FIELD

This application relates generally to firearms. In particular, this application relates to muzzle signature management device (MSMD), also known as flash suppressors, compensators, or muzzle brakes.

BACKGROUND

Many firearms, particularly automatic or semi-automatic rifles, use a muzzle signature management device to diffuse the force of the barrel discharge of firearms, which may allow for better control over the weapon and faster target reacquisition.

Generally, the majority of many automatic or semi-automatic rifles, such as AR-15/M4, AR-10/AR-308, AK-47, and many other semi-automatic platform rifles and carbines include a muzzle signature management device (muzzle brake, flash suppressor, and/or compensator). Large caliber and sniper rifles also frequently include a muzzle signature management device to reduce the flash and attempt to reduce the recoil from the rifle.

SUMMARY

A muzzle signature management device for a firearm is provided for managing a firearm discharge event. In one embodiment, the device includes a body having a bore through a central axis, where the body is generally tubular having a first end and a second end, and where the body comprises a muzzle attachment device disposed adjacent the first end. In another embodiment, the device includes a plurality of longitudinal openings extending along the central axis, each of the plurality of longitudinal openings extending at an angle with reference to the central axis, from a region adjacent the muzzle attachment device to the second end. The device may also include a plurality of ports, where each of the plurality of ports intersects at least one of the plurality of longitudinal openings, and where each of the plurality of ports extends from the bore to an exterior surface of the body.

In another embodiment, each of the plurality of ports may include a plurality of generally helical grooves formed on an interior surface of each port. Other surface features may also be included. These features may be scallops, serrations, and may be located in any of the plurality of linear ports. In some embodiments, there may be four generally coaxial linear ports and twelve linear ports intersecting the generally coaxially parallel linear ports (three for each generally coaxially parallel linear ports). The angle of the generally coaxially parallel linear ports may diverge from the bore axis by between 2 and 10 degrees.

In another embodiment, each of the plurality of ports extends outward radially from the bore at a non-orthogonal angle with respect to the central axis. The ports may extend outward at an angle in the range of between about 40 and 80 degrees, or between about 60 and 70 degrees. In another embodiment, the body includes a bevel formed in the exterior surface of the body around each opening of the plurality of ports in the exterior surface.

The body, in yet another embodiment, may include a plurality of troughs formed in the exterior surface of the body, where each trough extends in a longitudinal direction parallel to the central axis. Channels may extend from the bore to an area within one of the plurality of troughs. Additionally, a plurality of slots may be provided, where each of the plurality of slots extends from the second end of the body to a region adjacent the muzzle attachment device. In one embodiment, each of the plurality of slots intersects at least two of the plurality of ports. Each of slots may include parallel grooves formed in interior surfaces of the slot.

A system may also be provided. In one embodiment, the system includes a rifle having a muzzle, and the muzzle signature management device coupled to the muzzle.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Figure 1:
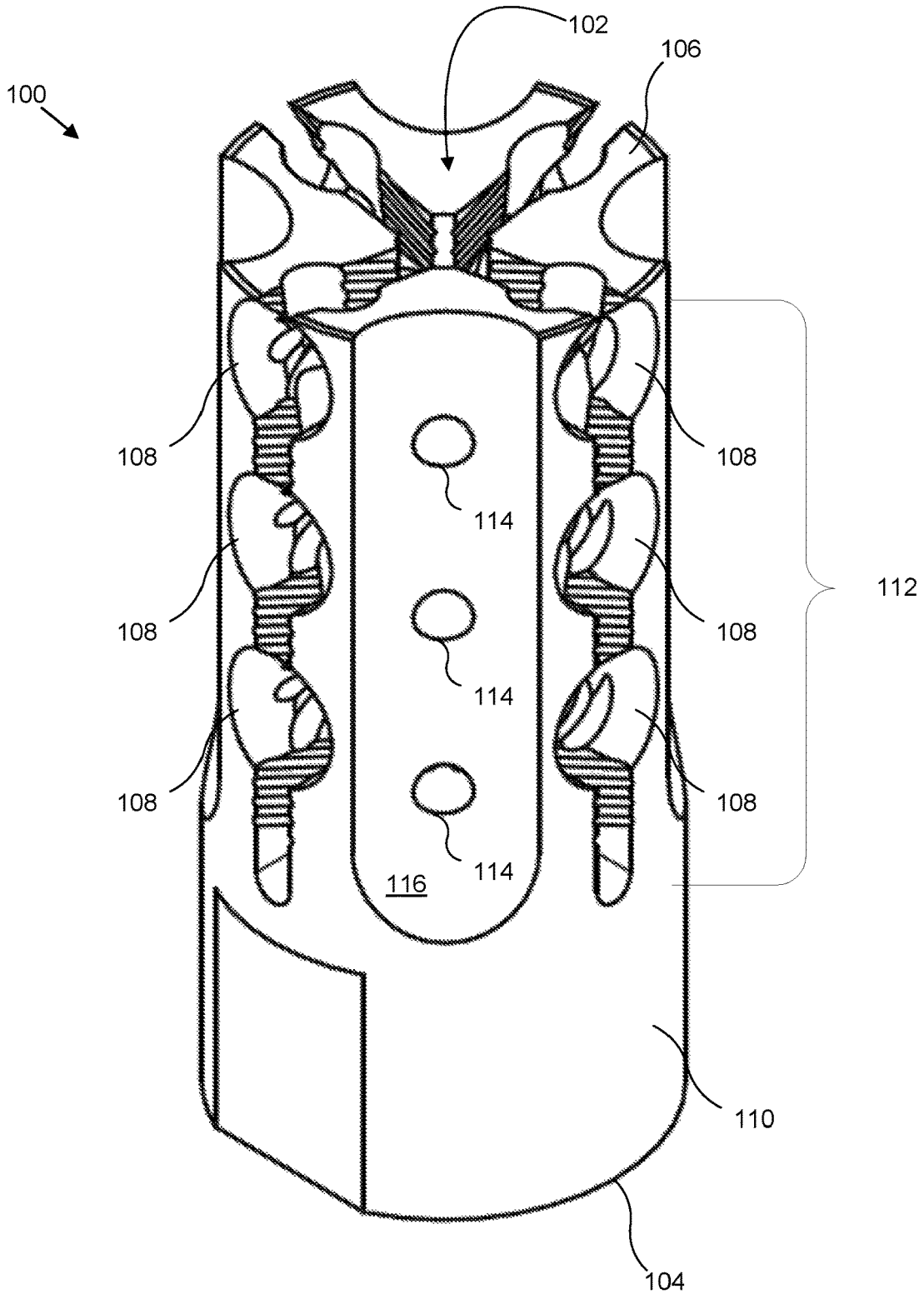
FIG. 1 is a perspective view diagram illustrating one embodiment of a muzzle signature management device in accordance with embodiments of the present disclosure.

In the Figures, an exemplary muzzle signature management device with advanced features is provided to improve each of the desired features of a general muzzle signature management device. Exemplary muzzle signature management devices such as the one shown in the Figures and primarily described below provide an improved combination of flash suppression, recoil reduction, muzzle control, and gas venting over any other muzzle signature management device design. The described muzzle signature management devices of the present disclosure provide the advantages sought in a muzzle signature management device without negatively impacting the dynamics, performance, and consistency of rounds fired from the rifle. In the Figures, some specific design and performance elements of the muzzle signature management device are provided in a configuration having 4-slots, twelve ports, and a vent forward design.

Each design feature has a specific purpose and will be explained below. However, the aggregate effect of the features is to not affect accuracy, to be quieter and direct both blast and sound out and forward, to be a highly effective flash hider, and to mitigate recoil and muzzle rise. The muzzle signature management device may be used with any rifle platform, but may be particularly useful in 3-gun and sniper comps, and practical/tactical applications where managing these muzzle signature elements is important.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to," unless expressly specified otherwise. An enumerated listing of items does not imply that any or all of the items are mutually exclusive, unless expressly specified otherwise. The terms "a," "an," and "the" also refer to "one or more" unless expressly specified otherwise.

Furthermore, the described features, structures, or characteristics of the embodiments may be combined in any suitable manner. In the following description, numerous specific details are provided to give a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

The description of elements in each figure may refer to elements of proceeding figures. Like numbers refer to like elements in all figures, including alternate embodiments of like elements. In the Figures, the thickness and configuration of components may be exaggerated for clarity.

FIG. 1 is a perspective view diagram illustrating one embodiment of a muzzle signature management device 100 in accordance with embodiments of the present disclosure. The muzzle signature management device 100, as depicted, is generally formed having a tubular shape and configured to attach to a rifle. A bore 102 passing from a first end 104 of the muzzle signature management device 100 to a second end 106 allows a projectile (not shown) to pass through. Stated differently, the muzzle signature management device 100 includes an opening that aligns with and extends the bore of a barrel of a rifle so that a fired projectile travels through the barrel, into the first end 104 and out of the second end 106.

A series of ports 108 may be formed in the muzzle signature management device 100, and extend substantially radially from the bore 102 to an outer surface 110 of the muzzle signature management device 100. In other words, each port 108 may extend from a central axis (that extends longitudinally through the bore 102) to the outer surface 110, and accordingly, form a series of openings between the bore 102 and the outer surface 110 through which gasses, blast, sound, and flash may escape. As will be described in greater detail below, ports 108 may be angled 25 degrees forward (toward second end 106) and may create more bearing area and direct gasses, blast, sound and flash forward away from the shooter and bystanders. Alternatively, the forward angle may be in the range of between about 15 and 40 degrees with reference to a perpendicular line that extends outward from the central axis (see FIG. 4).

A very critical and overlooked negative effect of most conventional muzzle brakes is that they tend to create potential safety issues. Many muzzle brakes direct the blast overpressure back (toward the first end 104) at the shooter. This blast overpressure can startle and affect the shooter's nervous system causing them to pull a shot and/or create microsecond delays in follow up shots, etc. It may also increase the risk of hearing damage. Reducing backward directed overpressure may also be an advantage when shooting from behind barricades or other cover where a neutral or backward directed blast signature is undesirable and may be harmful to the shooter.

Also depicted in FIG. 1 is a series of secondary openings, or channels 114. The apertures 114, as will be described below in greater detail, extend outward radially from the bore 102, in a substantially perpendicular direction with reference to a central longitudinal axis of the muzzle signature management device 100. The channels 114 may be disposed in between series of ports 108. Additionally, troughs 116 may be formed on the exterior surface 110 of the muzzle signature management device 100 and extend longitudinally (i.e., from the first end towards the second end). The channels 114 may be positioned such that a first opening of each channel 114 is disposed within one of the troughs 116, and a second opening of the channel is disposed in the bore 102. Stated differently, the channels 114 fluidly connect the bore 102 with the exterior surface 110.

Figure 2:
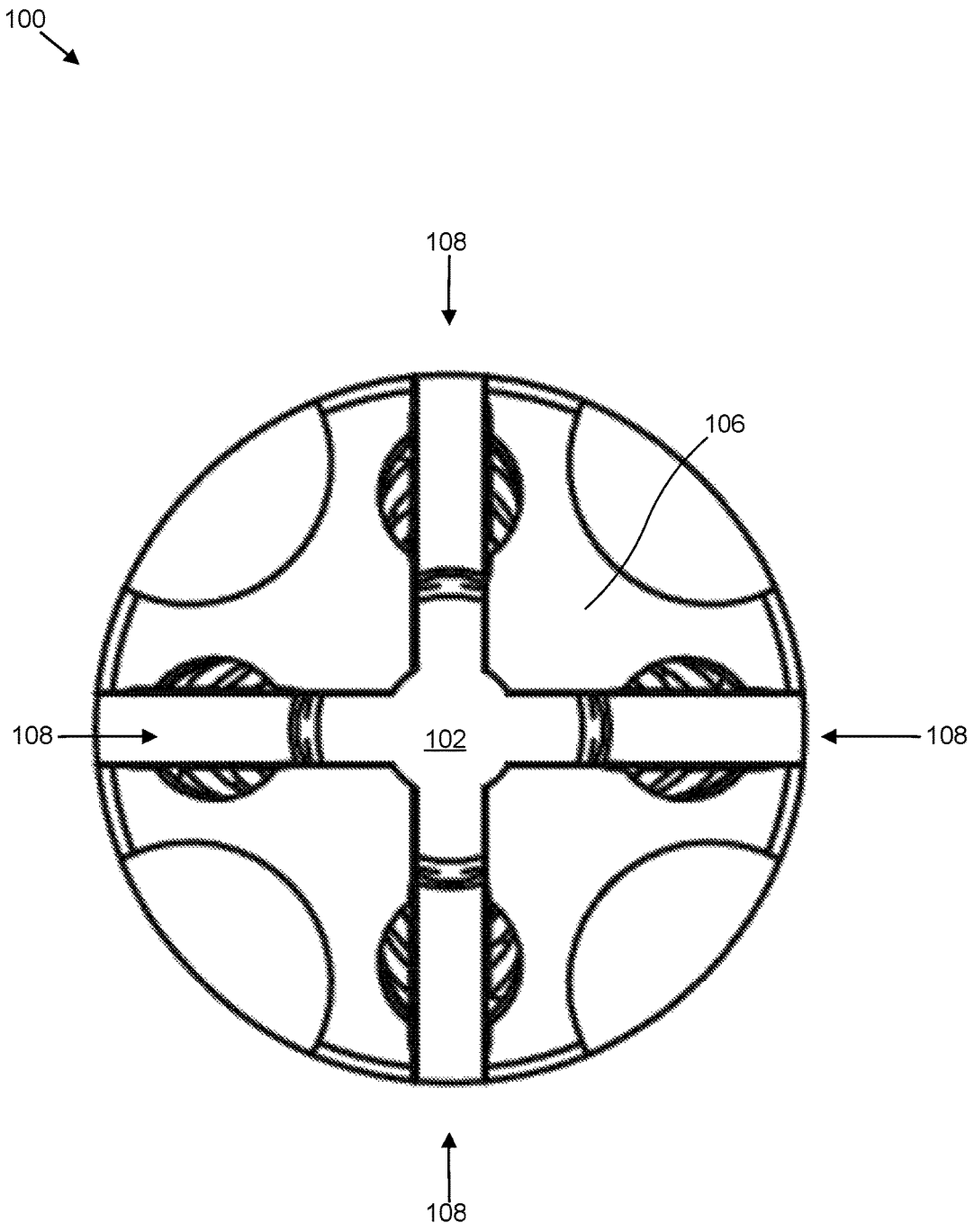
FIG. 2 is an end view diagram illustrating another embodiment of the muzzle signature management device in accordance with embodiments of the invention.

FIG. 2 is an end view diagram illustrating another embodiment of the muzzle signature management device 100 in accordance with embodiments of the invention. The depicted embodiment shows the second end 106 as if staring down the barrel of a rifle. In the depicted embodiment, the rows of ports 108 are shown extending outward radially from the bore 102 at the 12, 3, 6, and 9 o'clock positions (i.e., 90-degree separation between adjacent ports 108). In an alternative embodiment, the muzzle signature management device 100 may be formed with more or less rows of ports 108. In other words, the muzzle signature management device 100 may be formed with eight rows of ports 108 (i.e., 45-degree separation), or a single row of ports 108. In another embodiment, the muzzle signature management device 100 is formed with at least two opposing rows of ports 108 (i.e., at the 3 and 9 o'clock positions) so that forces from exhausting gasses are balanced.

Figure 3A:
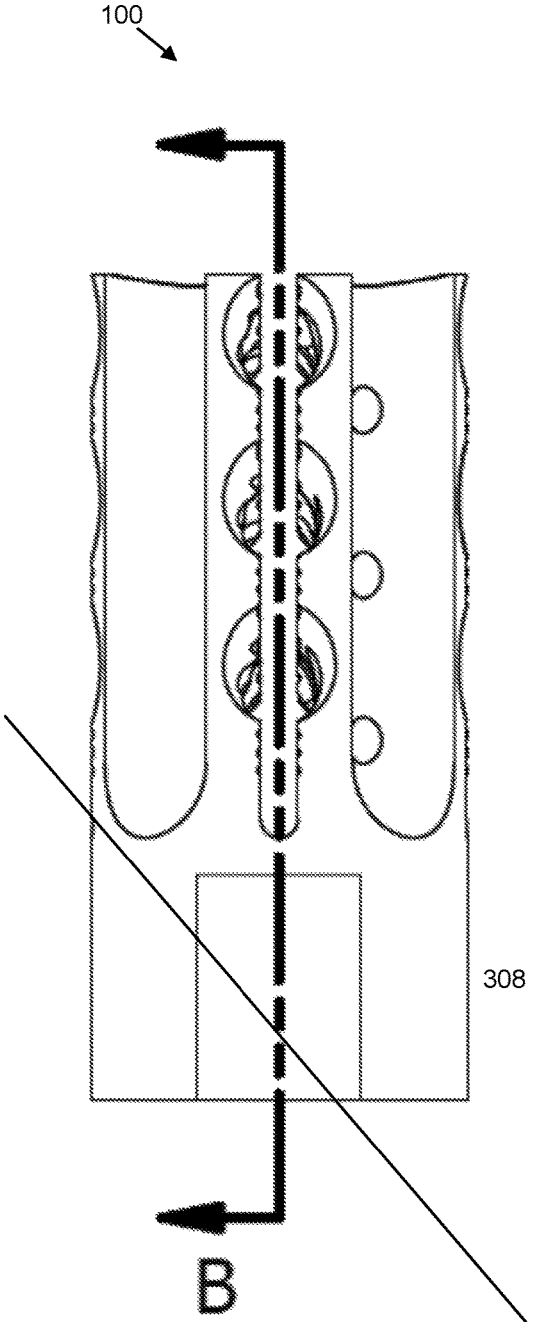
FIGS. 3*a* and 3*b* are diagrams illustrating another embodiment of the muzzle signature management device in accordance with embodiments of the present disclosure.
Figure 3B:
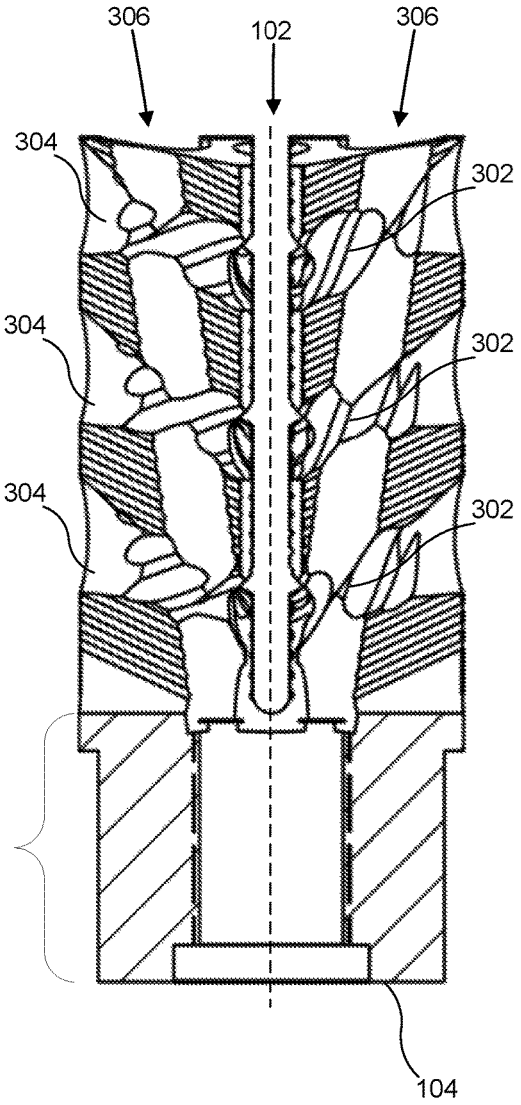

FIGS. 3*a* and 3*b* are diagrams illustrating another embodiment of the muzzle signature management device 100 in accordance with embodiments of the present disclosure. In particular, FIG. 3*b* is a cross-sectional diagram taken along line B of FIG. 3*a*, and illustrates helical grooves or flutes 302 formed in each of the ports 108. Helical flutes 302 in the ports 108 create more bearing area and dwell time for gasses against the port. Stated differently, the helical flutes 302 cause the exhausting gasses to slow by redirecting them to form vortices. This slows the gasses and saps energy from the movement of the gasses. Beneficially, this provides approximately the same dwell time and resistance of a 5 degree backward angled port or baffle, without the negative effects, as discussed above. The helical flutes 302 also slow and diffuse the gasses, which aids in flash suppression and provides a slight decrease in over pressure.

When the muzzle signature management device 100 is installed on a rifle and held level, the ports 108 may be evenly spaced at the 10 o'clock, 2 o'clock and 4 o'clock 8 o'clock, for example. When combined with the 5-degree forward port 108 and slot elements, creates a wide dispersion area of blast, flash, and sound signatures to reduce potential harm to the shooter and bystanders.

Bevels 304 at the mouth of the ports 308 may function to equalize the pressure in the ports during a shooting event with outside air as the gasses exit the port 108 by allowing expansion and diffusion of the blast signature. Testing has found that the bevels 304 serve to drop the pressure wave by about 40%. This affects two signature elements. First, the lower pressure and greater diffusion of the gasses means that when shooting prone, etc., there is less blast signature and disruption. Second, the lower and more diffused the pressure wave, the quieter the report, and subsequently the safety of the shooter is increased.

Also depicted in FIG. 3*b* are longitudinally extending openings that extend outward from a region adjacent the first end 104 towards the second end 106 at an angle relative to the central axis (i.e., the center of the bore 102). In one embodiment, the angle is in the range of between about 2 and 10 degrees. In another embodiment, the angle is about 5 degrees. The first end 104 is configured to receive the barrel of a rifle. This may be accomplished through any number of different barrel coupling mechanisms including, but not limited to, threaded engagements, quick-release couplings, etc. The longitudinally extending openings 306 extend from an area adjacent the barrel coupling region 308 towards the second end 106.

The four linear ports (openings 306) that run form the end of the muzzle signature management device 100 to the muzzle of the rifle may increase the overall flow of gasses in the muzzle signature management device 100, and aid the design in several important ways. First, the openings 306 increase the gas volume and flow through the muzzle signature management device 100. Second, the openings 306 help to pull the gasses that are chasing the base of the bullet off the centerline of the bore and out, reducing accuracy robbing turbulence at the muzzle. The more gasses pulled off the centerline and away from the base of the bullet the better the ballistic performance of the round. This helps to make the muzzle signature management device "bullet agnostic", where many designs with open baffles tend to like longer or shorter bullets depending on baffle spacing, as the gasses and overpressure on the baffle area create turbulence that affects bullet flight. Next, it allows all of the ports and openings to be active at once and additional gasses to be vented out the end and away from the bullets flight path. As the bullet passes the first set of ports, the openings 306 direct gasses out to the other two ports on each slot/channel 112 and out. This helps drop the pressure level of the gasses that are vented out of each port, which reduces blast and sound signature. Dropping the port pressure may slightly decrease the effectiveness as a recoil reducing muzzle brake, but improves a balanced design that deals more with controlling the muzzle movement and working in conjunction with a properly timed and tuned AR or other firearm and most AR cartridges don't need a lot or recoil mitigation if tuned right.

Figure 4:
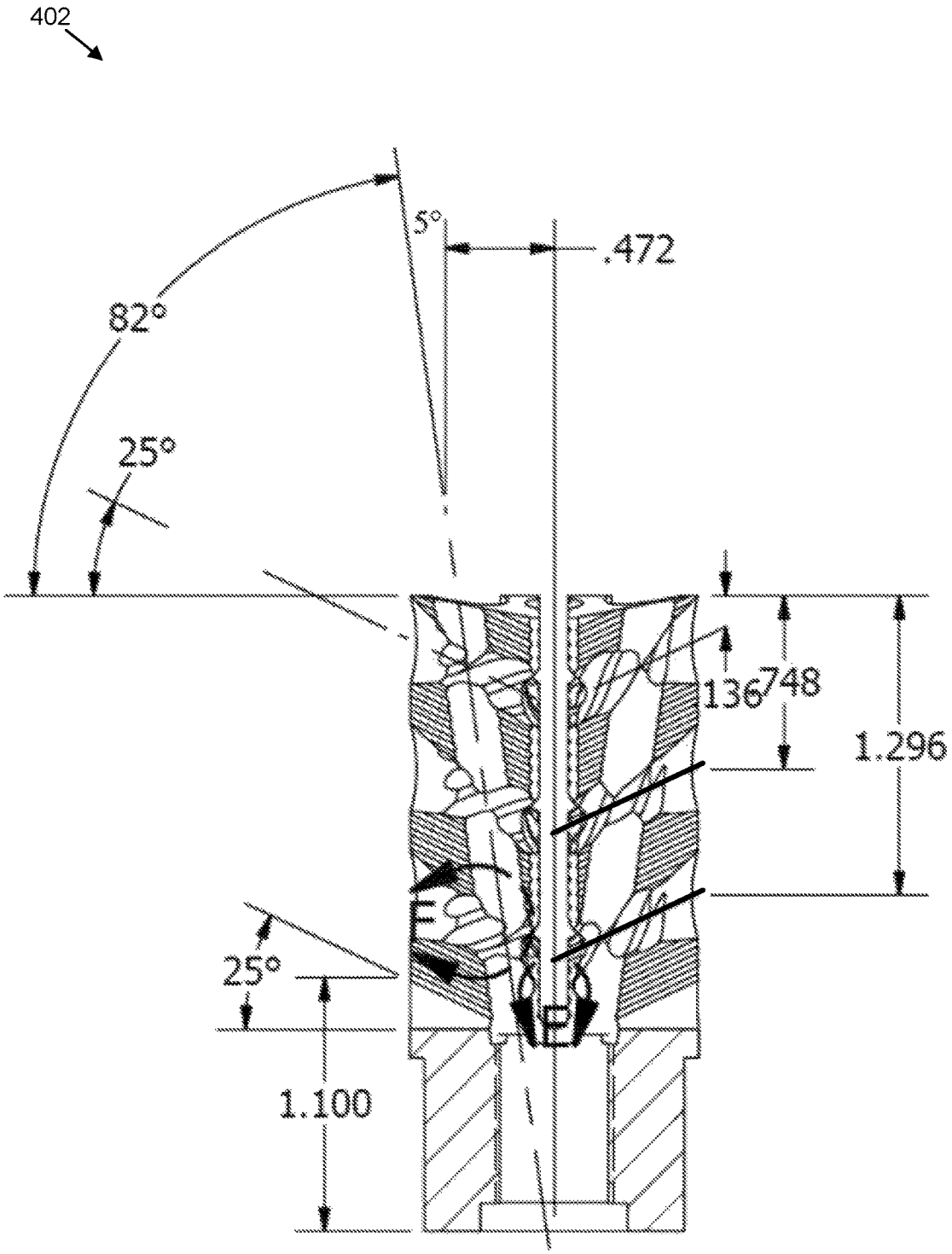
FIG. 4 is a cross-sectional diagram illustrating another embodiment of the muzzle signature management device in accordance with embodiments of the present disclosure.

FIG. 4 is a cross-sectional diagram illustrating another embodiment of the muzzle signature management device 100 in accordance with embodiments of the present disclosure. In the depicted embodiment, many callouts are identified for demonstrating angles and measurements. However, these angles and measurements are given by way of example only, and are not intended to be limiting. As one skilled in the art will recognize, the angles and distances may be modified for different sizes of rifles, different calibers of ammunition, etc. Stated differently, the principles and features described herein may be applied to different sizes and angles of muzzle signature management devices.

Figure 5A:
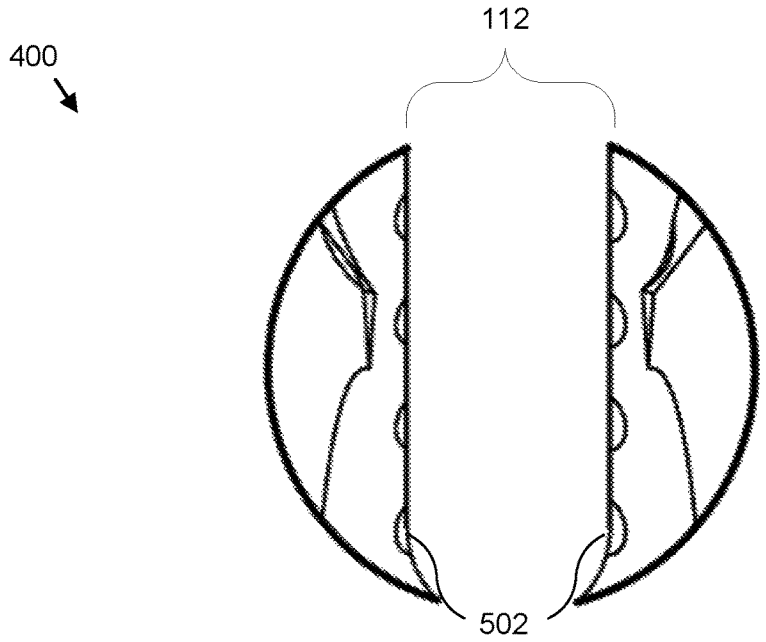
FIG. 5*a* is a schematic diagram illustrating one embodiment of detail area E of FIG. 4 in accordance with embodiments of the present disclosure.

FIG. 5*a* is a schematic diagram illustrating one embodiment of detail area E of FIG. 4 in accordance with embodiments of the present disclosure. The detail area E of FIG. 4 is a section of the bore 102 to illustrate grooves 502 that start at the bore 102 and extend outward radially on surfaces of the channel 112. The linear grooves 502 create greater surface area within the muzzle signature management device 100 and function in a manner similar to the helical grooves, described above, that slow, redirect, delay, diffuse, and dissipate the exhausting gasses of the rifle. The linear grooves 502, as depicted, extend outward radially from the central axis of the bore 102 on both sides of the channel 112 (see also FIGS. 1, 3, and 4). In one embodiment, the linear grooves 502 are angled at the same angle as a port 108 with reference to the central axis. In an alternative embodiment, the linear grooves 502 are angled at a different angle than the ports 108.

Figure 5B:
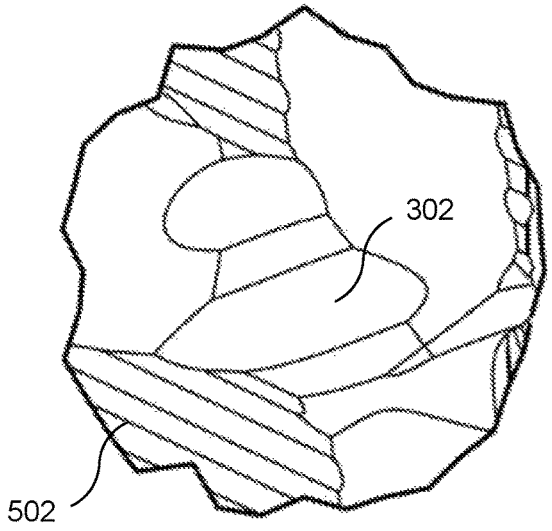
FIG. 5*b* is a schematic diagram illustrating one embodiment of detail area F of FIG. 4 in accordance with embodiments of the present disclosure.

FIG. 5*b* is a schematic diagram illustrating one embodiment of detail area F of FIG. 4 in accordance with embodiments of the present disclosure. The detail area F of FIG. 4 is a section of the port 108 having helical grooves 302 adjacent linear grooves 502. The various grooves (linear and helical) intersect in different regions throughout the muzzle signature management device 100. This is beneficial in that exhausting gasses are redirected down one of many different channels formed by the different grooves for redirecting, delaying, diffusing, and dissipating the exhausting gasses.

Figure 6A:
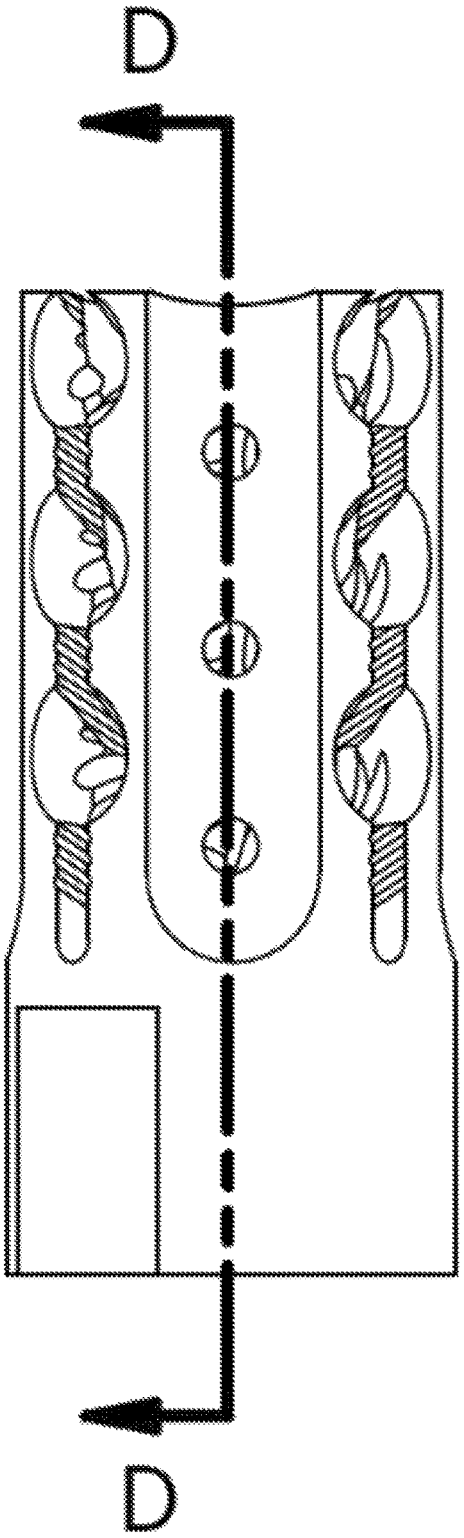
FIGS. 6*a* and 6*b* are diagrams illustrating another embodiment of the muzzle signature management device in accordance with embodiments of the present disclosure.
Figure 6B:
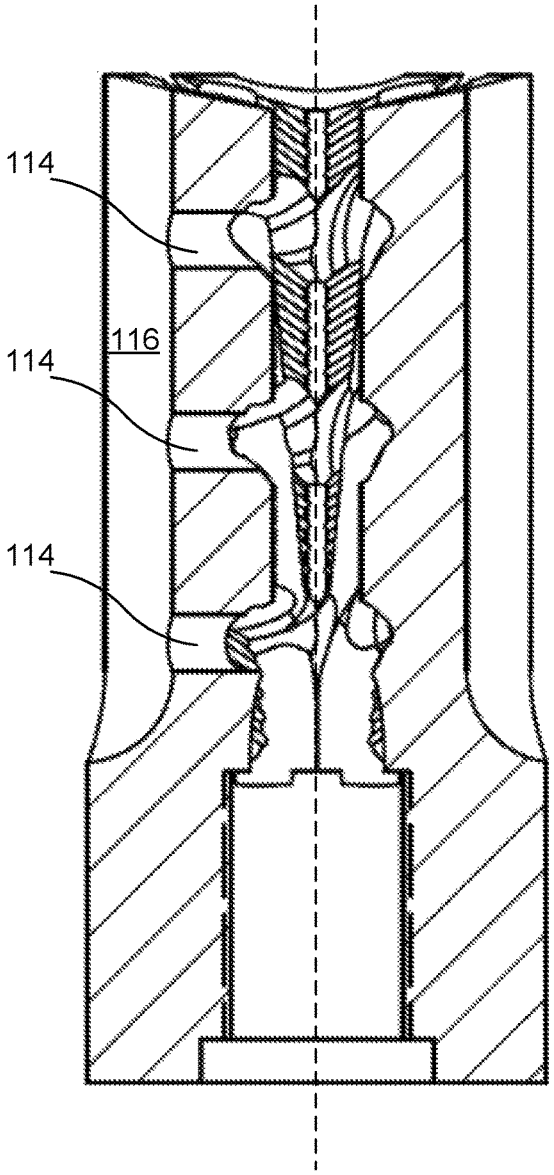

FIGS. 6*a* and 6*b* are diagrams illustrating another embodiment of the muzzle signature management device 100 in accordance with embodiments of the present disclosure. In particular, FIG. 6*b* is a cross-sectional diagram taken along line D of FIG. 6*a*, and illustrates the channels 114 and the troughs 116 in accordance with embodiments of the present disclosure. In the depicted embodiment, the channels 114 extend outward from the central axis in a direction generally perpendicular to the central axis. As described above, the channels 114 may terminate in a region disposed within one of the troughs 116. Alternatively, the channels 114 may extend to an area not within a trough 116. The channels 114 may be positioned linearly (i.e., along a common longitudinal line) as depicted. The channels 114 function to redirect gasses in a manner similar to the embodiments described above.

Figure 7:
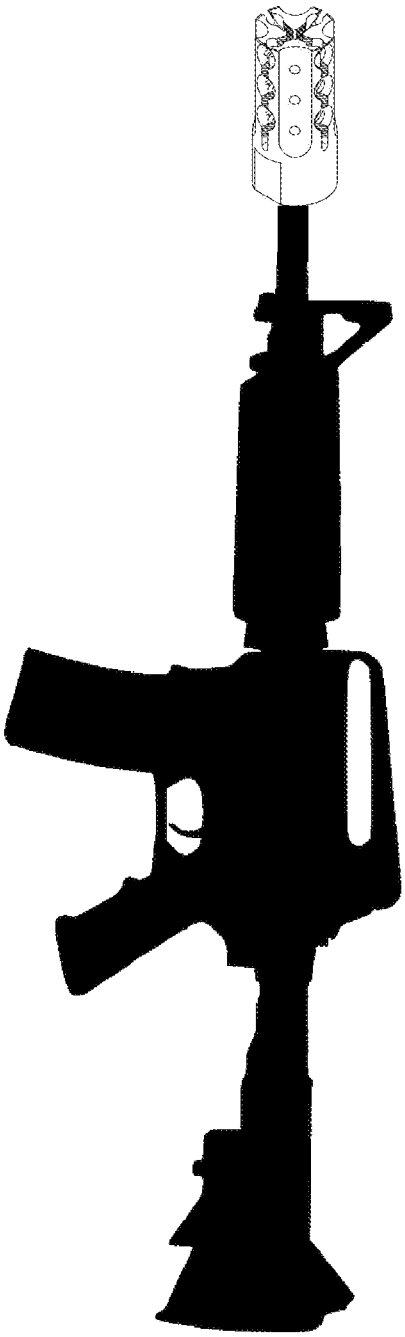
FIG. 7 is a side view diagram illustrating one embodiment of a system for managing the signature of a firearm discharge event in accordance with embodiments of the present disclosure.

FIG. 7 is a side view diagram illustrating one embodiment of a system for managing the signature of a firearm discharge event in accordance with embodiments of the present disclosure. In the depicted embodiment, the muzzle signature management device 100 of FIG. 1 is depicted attached to a semi-automatic rifle. Although the general outline of an AR-style rifle is depicted, the muzzle signature management device 100 may be adapted to couple to any rifle.

The muzzle signature management device is configured to couple to the muzzle of the rifle, and as described above, may be threaded or otherwise coupled. For example, different quick-release coupling mechanisms may be utilized.

Of course, any suitable material may be used for the components listed above, such as various steels, aluminum alloys, and other alloys. In addition to any previously indicated modification, numerous other variations and alternative arrangements may be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use may be made without departing from the principles and concepts set forth herein. Also, as used herein, examples are meant to be illustrative only and should not be construed to be limiting in any manner. All changes which come within the meaning and range of equivalency of the claims are to be embraced within their scope.

What is claimed is:

1. A muzzle signature management device comprising:

a body having a bore through a central axis, where the body is generally tubular having a first end and a second end, and where the body comprises a muzzle attachment device disposed adjacent the first end;

a plurality of longitudinal openings extending along the central axis, each of the plurality of longitudinal openings extending at an angle with reference to the central axis, from a region adjacent the muzzle attachment device to the second end; and a plurality of ports, where each of the plurality of ports intersects at least one of the plurality of longitudinal openings, and where each of the plurality of ports extends from the bore to an exterior surface of the body.

2. The muzzle signature management device of claim 1, where each of the plurality of ports comprises a plurality of generally helical grooves formed on an interior surface of each port.

3. The muzzle signature management device of claim 1, where each of the plurality of ports extends outward radially from the bore at a non-orthogonal angle with respect to the central axis.

4. The muzzle signature management device of claim 3, where the non-orthogonal angle is an angle in the range of between about 40 and 80 degrees.

5. The muzzle signature management device of claim 4, where the non-orthogonal angle is in the range of between about 60 and 70 degrees.

6. The muzzle signature management device of claim 1, further comprising a plurality of troughs formed in the exterior surface of the body, where each trough extends in a longitudinal direction parallel to the central axis.

7. The muzzle signature management device of claim 6, further comprising a plurality of channels extending from the bore to an area within one of the plurality of troughs.

8. The muzzle signature management device of claim 1, further comprising a plurality of slots, where each of the plurality of slots extends from the second end of the body to a region adjacent the muzzle attachment device.

9. The muzzle signature management device of claim 8, where each of the plurality of slots intersects at least two of the plurality of ports.

10. The muzzle signature management device of claim 9, where each of the plurality of slots further comprises a plurality of parallel grooves formed in interior surfaces of the slot.

11. A device attachable to a muzzle of a rifle, the device comprising:

a body having a bore through a central axis, where the body is generally tubular and having a first end and a second end, and where the body comprises a muzzle attachment device disposed adjacent the first end;

a plurality of ports extending from the bore to an exterior surface of the body; and a plurality of generally helical grooves formed on interior surfaces of each of the plurality of ports.

12. The device of claim 11, where each of the plurality of ports extends outward radially from the bore at a non-orthogonal angle with respect to the central axis.

13. The device of claim 12, where the non-orthogonal angle is an angle in the range of between about 40 and 80 degrees.

14. The device of claim 13, where the non-orthogonal angle is in the range of between about 60 and 70 degrees.

15. The device of claim 12, further comprising a bevel formed in the exterior surface of the body around each opening of the plurality of ports in the exterior surface.

16. The device of claim 11, further comprising a plurality of troughs formed in the exterior surface of the body, where each trough extends in a longitudinal direction parallel to the central axis.

17. The device of claim 16, further comprising a plurality of channels extending from the bore to an area within one of the plurality of troughs.

18. The device of claim 11, further comprising a plurality of slots, where each of the plurality of slots extends from the second end of the body to a region adjacent the muzzle attachment device and intersects at least two of the plurality of ports.

19. The device of claim 18, where each of the plurality of slots further comprises a plurality of parallel grooves formed in interior surfaces of the slot.

20. A system for controlling the signature of a firearm discharge event, the system comprising:

a rifle having a muzzle;

a muzzle signature management device coupled at a first end to the muzzle, the muzzle signature management device comprising:

a body having a bore through a central axis, where the body is generally tubular and having a first end and a second end, and where the body comprises a muzzle attachment device disposed adjacent the first end;

a plurality of ports extending from the bore to an exterior surface of the body; and a plurality of generally helical grooves formed on interior surfaces of each of the plurality of ports.

* * * * *